US005915158A

United States Patent [19]

Minagawa et al.

[11] Patent Number: 5,915,158

[45] Date of Patent: Jun. 22, 1999

[54] VARIABLE-TIMING AUTOMATIC DOCUMENT FEEDING DEVICE AND METHOD

[75] Inventors: Yoshihiko Minagawa, Yamanashi-ken; Masashi Yamashita; Hiroshi Mukouyama, both of Kofu, all of Japan

[73] Assignee: Nisca Corporation, Yamanashi-ken, Japan

[21] Appl. No.: 08/777,080

[22] Filed: Dec. 30, 1996

[30] Foreign Application Priority Data

Dec. 28, 1995 [JP] Japan ..... 7-353615

[51] Int. Cl.[6] ..... G03G 15/00

[52] U.S. Cl. ..... 399/370; 358/498

[58] Field of Search ..... 399/367, 370, 399/361; 358/505, 474, 498, 488; 271/225, 902

[56] References Cited

U.S. PATENT DOCUMENTS

| | | | |
|---|---|---|---|
| 4,943,832 | 7/1990 | Emori | 399/367 X |
| 5,223,905 | 6/1993 | Yamada et al. | 399/370 |
| 5,327,205 | 7/1994 | Baba | 399/370 |
| 5,379,128 | 1/1995 | Ishida et al. | 358/474 X |
| 5,563,699 | 10/1996 | Tsukamoto | 399/370 |

*Primary Examiner*—S. Lee

*Attorney, Agent, or Firm*—Kane, Dalsimer, Sullivan, Kurucz, Levy, Eisele and Richard, LLP

[57] ABSTRACT

In a device and method for feeding one by one documents including a preceding document to be fed earlier and a following document to be fed later to an image scanning station having a scanning reference point, the document being transported toward the image scanning station is first measured to find the length of the document, so that the following document is introduced into the image scanning station with timing varying with the length of the preceding document after the preceding document is treated and discharged. In a case that the following document passes past the scanning reference point just when the preceding document is discharged, the following document is moved backward to the scanning reference point, but if the following document does not reach the scanning reference point at that time, it is further forwarded to the appropriate image scanning station, consequently to shorten the interval of transporting the preceding and following documents, thus speeding up the image processing operation.

12 Claims, 12 Drawing Sheets

MEASURING CIRCUIT FOR DOCUMENT LENGTH
TIMING SETTING CIRCUIT
MODE SETTING CIRCUIT
MEMORY(A)
MEMORY(B)
PROCESSING CIRCUIT
M1
M2
RX
Dn
Dn+1
Ln
Ln+1
Ln-Ln+1
10
11
12
16a
17a
21
30
32
40
41
42
43
50
51
52
60
61
62
62a
62b
63
64
65
s1
s3
s4

32
s4
R2
21
32
31
RX
Lm
Dm
23
Dm
Dm+1
PX
Lw
R1
s1
17a
s3
Dm+1
?

32
Dm
Td
Ld
Lw
s4
R2
21
32
31
Dm
RX
Dm+1
Dm+1
11
PX
Lw
R1
s1
17a
s3

VARIABLE-TIMING AUTOMATIC DOCUMENT FEEDING DEVICE AND METHOD

BACKGROUND OF THE INVENTION

1. Field of the Invention

This invention relates to a document feeding device and method for automatically supplying documents to be scanned to an image processing system such as a copying machine, and particularly to an automatic document feeding device capable of transporting documents one by one to an image scanning station defined on the document processing system with variable timing in accordance with the length of the document being transported, thus to shorten the time required for transporting the documents.

2. Description of the Prior Art

In image processing systems such as a copying machine, facsimile and image scanner, which are adapted to read or scan various information such as characters and graphics on a document, the document handling operation for supplying and discharging the given document relative to an image scanning station (exposure position) of the image processing system influences the processing time of the image processing system when handling a number of documents to be scanned. There has been hitherto proposed some document feeding devices designed for shortening the time required for handling the documents in the image processing systems.

As shown in FIG. 1 and FIG. 2, a familiar automatic document feeding device ADF is usually mounted on an image processing system M such as a copying machine so as to overlay an exposing platen P on which the document is positioned to be scanned or imaged. The document feeding device fundamentally comprises a document supply tray 11 on which one or more documents D are stacked, a document supplying mechanism 10 for sending the document from the document supply tray 11 to a document scanning station RX defined on the aforesaid exposing platen, a document discharging mechanism 30 for discharging the document, after scanned, through a passage located opposite to the document supplying mechanism 10 astride the document scanning station RX, and a document discharge tray 31 for receiving the document sent out through the document discharging mechanism 30.

That is to say, the document which is sent from the document supply tray 11 to the document scanning station RX through a supply passage R1 by actuating the document supplying mechanism 10 usually has its tail end positioned at a scanning or exposing reference point PX defined in the document scanning station RX so as to be scanned. After carrying out the desired image processing, the document is sent out to the discharge tray 31 through a discharge passage R2.

In order to increase the allover image processing speed of the image processing system, although it is a matter of course to speed up the rate of transporting the document, the intervals at which the documents are successively fed to the document scanning station may be shortened.

However, there is a limit in performance of feeding the document at high speed. When the document is fed at excessively high speed, disadvantageous problems of damaging the document and rendering the positioning of the document difficult will possibly arise.

Japanese Patent Application Public Disclosure No. SHO 59-78052 discloses a simple feeding method in which, after a preceding document sent earlier is completely discharged upon undergoing the desired image processing, a following document to be sent later starts to travel. This method is repeated for feeding succeeding documents, resulting in decreasing the speed of the document processing operation (inclusive of the scanning operation in the copying machine).

To be more specific, the timing of feeding the documents may be provided so that the preceding document D1 fed to the document scanning station with the tail end positioned at the scanning reference point PX as shown at the time t1 in FIG. 3 undergoes the desired image processing, and then, is sent out from the document scanning station. Thereafter, at the time that the preceding document D1 arrives at the discharge tray 31, the following document D2 arrives at the prescribed scanning station simultaneously.

Such a simultaneous document feeding method as noted above can be fulfilled on condition that the time taken for advancing the preceding document after being scanned from the image scanning station to the discharge tray is equal to the time taken for moving the following document from the supply tray to the image scanning station. This method enjoys high speed feeding operation, because the time for discharging the preceding document and the time for feeding the following document can be spent simultaneously as if the time for feeding the following document is neglected.

As touched upon above, the aforesaid feeding method is premised on an assumption that the documents to be discharged and fed at one time in the feeding device have the same size (length), and the interval between the preceding and following documents transported at one time is equal to the distance by which the document travels to be discharged from the image scanning station. However, this method cannot be materialized if the documents have different sizes.

Referring to FIG. 4, in a case where the length L2 of the following document D2 is shorter than the length L1 of the preceding document D1, e.g. the preceding document is A4 size (210 mm×297 mm) and the following document is A5 size (148 mm×210 mm), there will be possibly brought about an awkward situation such that the preceding document D1 is not completely discharged yet in spite of the fact that the following document D2 arrives at the image scanning station with the tail end positioned at the scanning reference point PX (as shown at t4 in FIG. 4).

This is because such a conventional document feeding system fundamentally has no function of previously recognize the length of the document to be transported, and cannot determine the timing of transporting the preceding and following documents in conformity with the lengths of the documents. That is, even if a document sensor s1 is disposed on the supply passage R1 to measure the length of the document traveling along the passage as shown in FIG. 4, the length of the document (L2 in the drawing) cannot be recognized until the document completely passes through the sensor s1 as shown by t2–t3.

Accordingly, in the case that the preceding document D1 is longer and the following document D2 is shorter, the longer document D1 is left in the discharge passage R2 during image processing for the following shorter document D2. Also when both the preceding and following documents are short, the transporting of the documents cannot successfully be controlled. Although it is possible to prevent the preceding document from being left in the discharge passage by determining the time interval from the commencement of discharging the preceding document to the commencement of feeding the following document in accordance with the difference in size between the maximum document and the minimum document which can be handled by the image processing system in principle, such a method of feeding the documents calls for a wasteful time and is not useful in solving the problem. The document feeding system adopting the method can be expected to perform rational feeding and discharging operations by using a complicated control system, thus inevitably turning out to be expensive, complicated in structure, and susceptible to mechanical troubles during service.

Even by taking a method in which the feeding of the following document from the supply tray is started at the same time as the commencement of the discharging of the preceding document after being scanned at the image scanning station, the constituent elements other than the document supplying mechanism are at rest wastefully while the following document is transferred from the document supply tray to the image scanning station.

OBJECT OF THE INVENTION

An object of the present invention is to provide an automatic document feeding device and method which enables documents to be successively and stably fed to and discharged from an image scanning station defined in an image processing system at high speed.

Another object of the invention is to provide an automatic document feeding device capable of recognizing the size or length of the document being transported, so as to rationally perform the document transporting operation by varying the timing of feeding the document in accordance with the size of the document even when dealing with the documents different in size, thus shortening the time require for transporting the documents successively.

Still another object of the invention is to provide an automatic document feeding device capable of rationally carrying out the document transporting operation by performing image processing for the preceding document at the image scanning station while leaving the following document waiting at a standby point adjacent to the image scanning station, so that the following document starts advancing toward the image scanning station at the time that the preceding document after being scanned is sent out from the image scanning station, and by measuring the size of the following document traveling toward the image scanning station so as to feed the following document in accordance with the size of the following document, resultantly to improve the image processing speed of the image processing system.

Yet another object of the invention is to provide an automatic document feeding device capable of rationally performing a high-speed document feeding operation with a simple driving and controlling system, and being versatilely applicable to image processing devices such as a copying machine, facsimile and image scanner with ease.

SUMMARY OF THE INVENTION

To attain the objects described above according to this invention, there is provided an automatic document feeding device for feeding and discharging documents to and from an image scanning station having a scanning reference point, which comprises a document supplying mechanism for sending off given documents one by one to the image scanning station, means for measuring the size of the document traveling through the document supplying mechanism, a document transport unit for moving the document fed from the document supplying mechanism along the image scanning station and positioning the document at the scanning reference point, a document discharging mechanism for discharging the document from the image scanning station, and means for controlling transporting of the document with timing varying with the size of the document measured by the measuring means.

The documents set on the document supplying mechanism are sent off one by one to the image scanning station through a document supply passage. The document is measured to recognize the size thereof by using the measuring means, while traveling along the document supply passage. The document is sent to and stopped at the image scanning station with the tail end aligned with the scanning reference point, to undergo the desired image processing.

During the image processing of the preceding document at the image scanning station, the following document is sent to a document standby point defined close to the image scanning station.

The preceding document after being scanned at the image scanning station is transported in the forward direction, and then, the following document waiting at the standby point starts advancing with feeding timing determined in accordance with the size of the preceding document.

At the time that the preceding document is discharged, the length by which the following document moves from the document standby point is measured to recognize the position of the following document in the image scanning station. When the tail end of the following document moves past the scanning reference point, the document transport unit is reversed to return the following document until the tail end thereof reaches the scanning reference point. When the tail end of the following document does not yet arrive at the scanning reference point at that time, the following document is further forwarded until the tail end thereof reaches the scanning reference point.

The succeeding documents are repeatedly fed one by one to the image scanning station in the same way as noted above while performing the desired image processing operation.

Other objects and features of the present invention will be hereinafter explained in detail with reference to the accompanying drawings.

DESCRIPTION OF THE PREFERRED EMBODIMENTS

Figure 1:
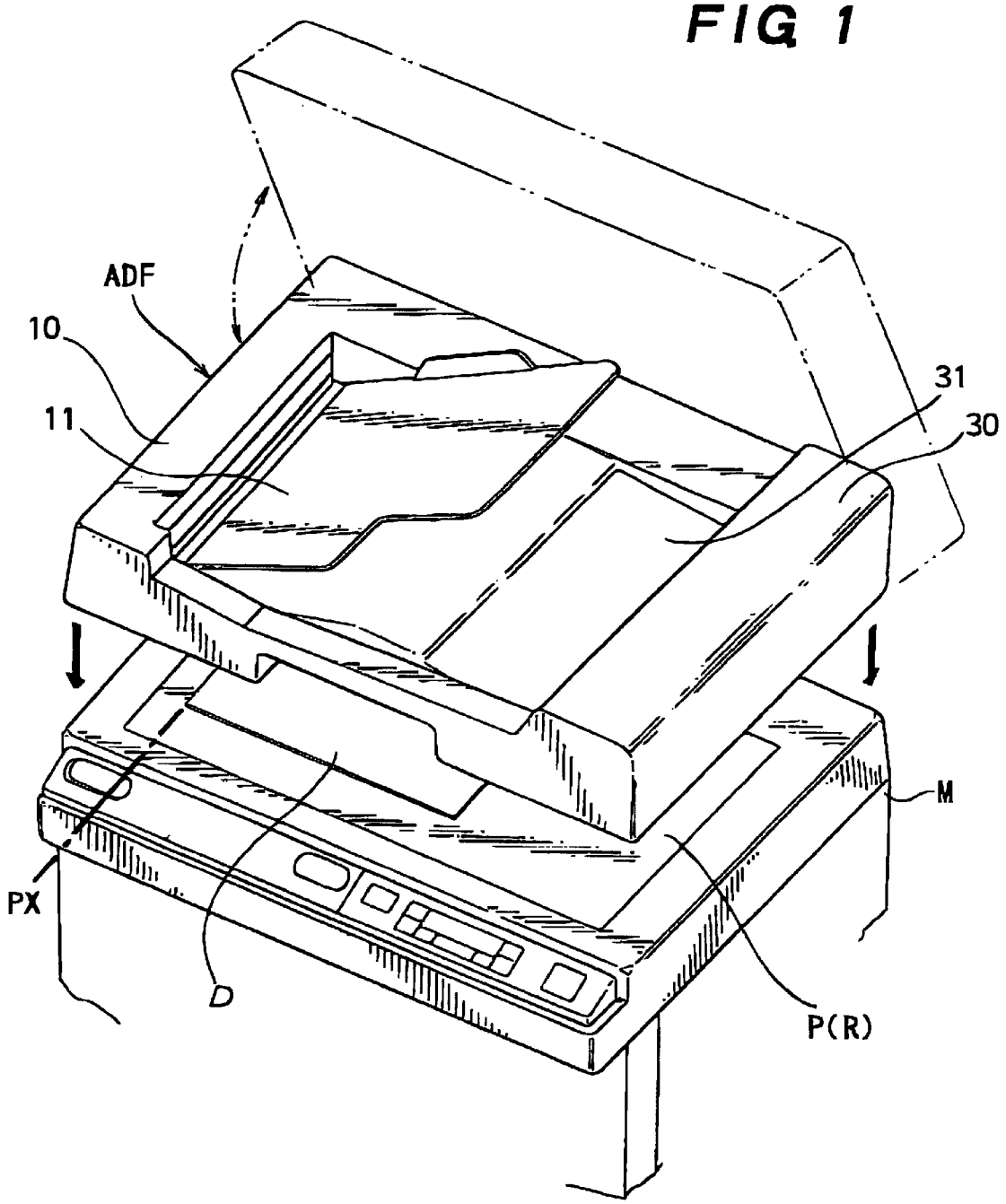
FIG. 1 is a schematic perspective view showing one example of applying an automatic document feeding device to an image processing system.
Figure 2:
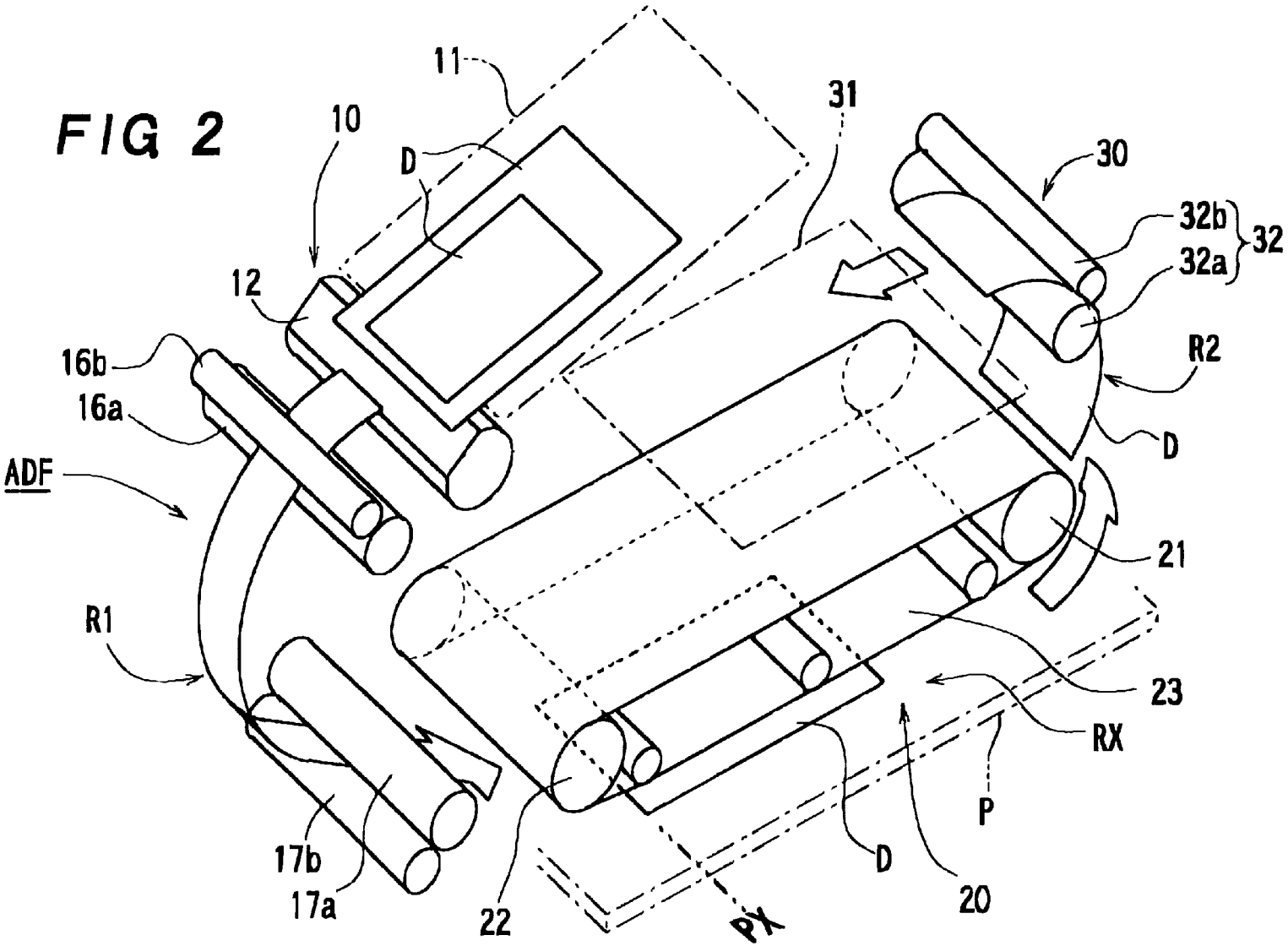
FIG. 2 is an explanatory diagram schematically showing a document transporting route in the document feeding device.

This invention provides an automatic document feeding device to be applied to various image processing devices such as a copying machine, facsimile and image scanner, so that given documents are fed one by one to an image scanning station defined on the image processing device with variable timing determined in accordance with the size of the document being transported, thus to speed up the rate of transporting the documents. FIG. 1 shows the automatic document feeding device ADF disposed onto the copying machine by way of example of the image processing device M.

As illustrated, the automatic document feeding device ADF according to this invention is mounted on the image processing device M so as to overlay an exposing platen P made of transparent glass or the like, on which an image scanning station RX is defined. Generally, the document feeding device is openably attached to the image processing device M by using hinge members (not shown).

The image scanning station RX defined on the platen P has an area equal to or somewhat larger than the maximum document which can be handled by the image processing device. The disclosure of the invention will be made herein on the assumption that the maximum document of A3 size (297 mm×420 mm) can be handled, but the documents of A4 size or letter size smaller than the maximum document are most frequently used in the majority of cases, as seen in a common copying machine.

The document fed to the image scanning station RX defined on the platen P has the tail end positioned at a scanning reference point or exposing reference point PX at the time of effecting the desired image processing.

The document feeding device ADF comprises a document supplying mechanism 10 including a document supply tray 11 on which one or more documents D1, D2, . . . (Dn; n≧1) to be scanned are stacked, a document transport unit 20 which overlays the platen P to define the image scanning station RX therebetween, a document discharging mechanism 30 having a document discharge tray 31, and means 60 for controlling component members constituting the supplying mechanism 10, transport unit 20 and discharging mechanism 30.

The supply tray 11 and discharge tray 31 are superposed over one another above the image scanning station RX formed between the platen P and the transport unit 20. The documents Dn stacked on the supply tray 11 are fed one by one to the image scanning station RX through a document supply passage R1 curved in a substantially semicircle in the document supplying mechanism 20, and after being treated, sent out from the image scanning station RX to the discharge tray 31 through a document discharge passage R2 curved in a substantially semicircle in the document discharging mechanism 30.

Figure 3:
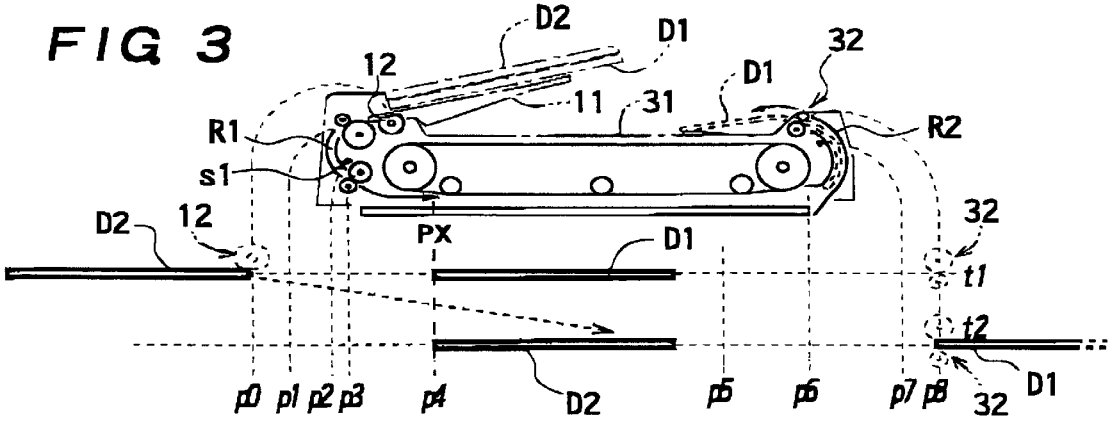
FIG. 3 is a schematic view showing a document feeding operation in a conventional document feeding device.
Figure 4:
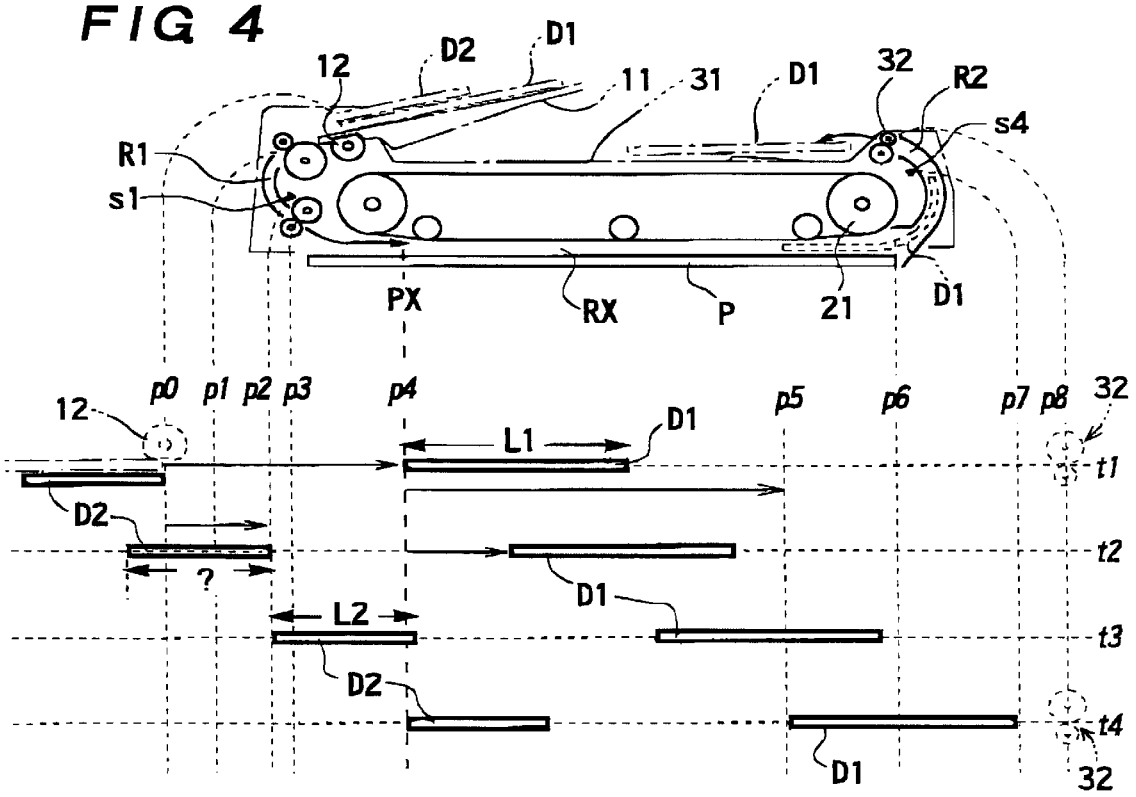
FIG. 4 is a schematic view showing a document feeding operation in another conventional document feeding device.
Figure 5:
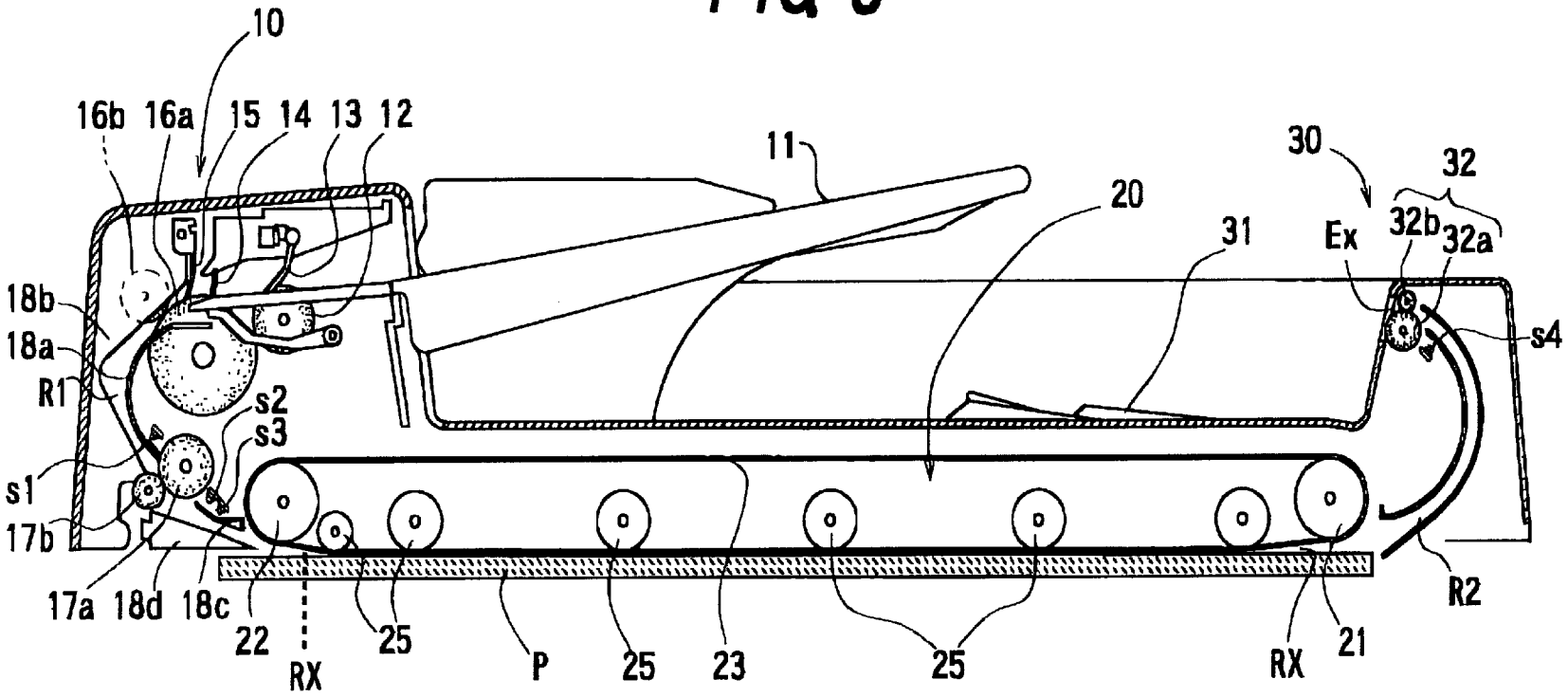
FIG. 5 is a side section schematically showing one embodiment of an automatic document feeding device according to this invention.

As shown in FIG. 3 and FIG. 4, the document supplying mechanism 10 includes a kick roller 12 for sending off one document from the documents Dn (n=1, 2, . . . ) stacked on the supply tray 11, an empty sensor 13 for detecting the document on the supply tray 11, a gate means 14 which assumes its upper position on standby to restrain the documents stacked on the document supply tray from advancing, and retracts downward to allow the document to go therepast upon reception of a document feeding instruction, a document scraper 15 made of elastic material for preventing two or more documents sent out from the supply tray 11 by using the kick roller 12, paired separation rollers 16*a* and 16*b* for separating two or more documents possibly passing the document scraper 15 in order to permit only one document to pass, and paired register rollers 17*a* and 17*b* for making skew correction of the document traveling along the document supply passage R1. Denoted by 18*a* to 18*d* are guide members which constitute the document supply passage R1.

The kick roller 12, separation rollers 16*a* and 16*b*, and register rollers 17*a* and 17*b* are arranged along the semicircularly curved supply passage R1, so that the documents stacked on the supply tray 11 are sent off one by one in the sequence from the lowermost document to the upper documents through the document supply passage R1 and delivered to the image scanning station RX formed beneath the document transport unit 20.

Between the paired separation rollers 16*a*, 16*b* and paired register rollers 17*a*, 17*b*, there is disposed a document sensor s1 for detecting the document traveling along the document supply passage R1 to determine the length of the document and timing with which the register rollers 17*a* and 17*b* are operated. On the downstream side of the register rollers 17*a* and 17*b*, there are disposed a sensor s2 for detecting the width of the document passing thereby, and a timing sensor s3.

The structure and arrangement of the kick roller 12, empty sensor 13, gate means 14, document scraper 15, separation rollers 16*a* and 16*b*, and register rollers 17*a* and 17*b* are not specifically limited, and any other elements may be used instead. For instance, although the document separating means is composed of a pair of rollers in the illustrated embodiment, the separation roller 16*b* may be replaced by an elastic friction pad or plate, while using the separation roller 16*a* on the driving side. Also, a plurality of document scrapers may be disposed along the document supply passage to increase the function of preventing a plurality of documents from passing therethrough. In these manners, these component elements of the device may be modified variously.

Figure 6:
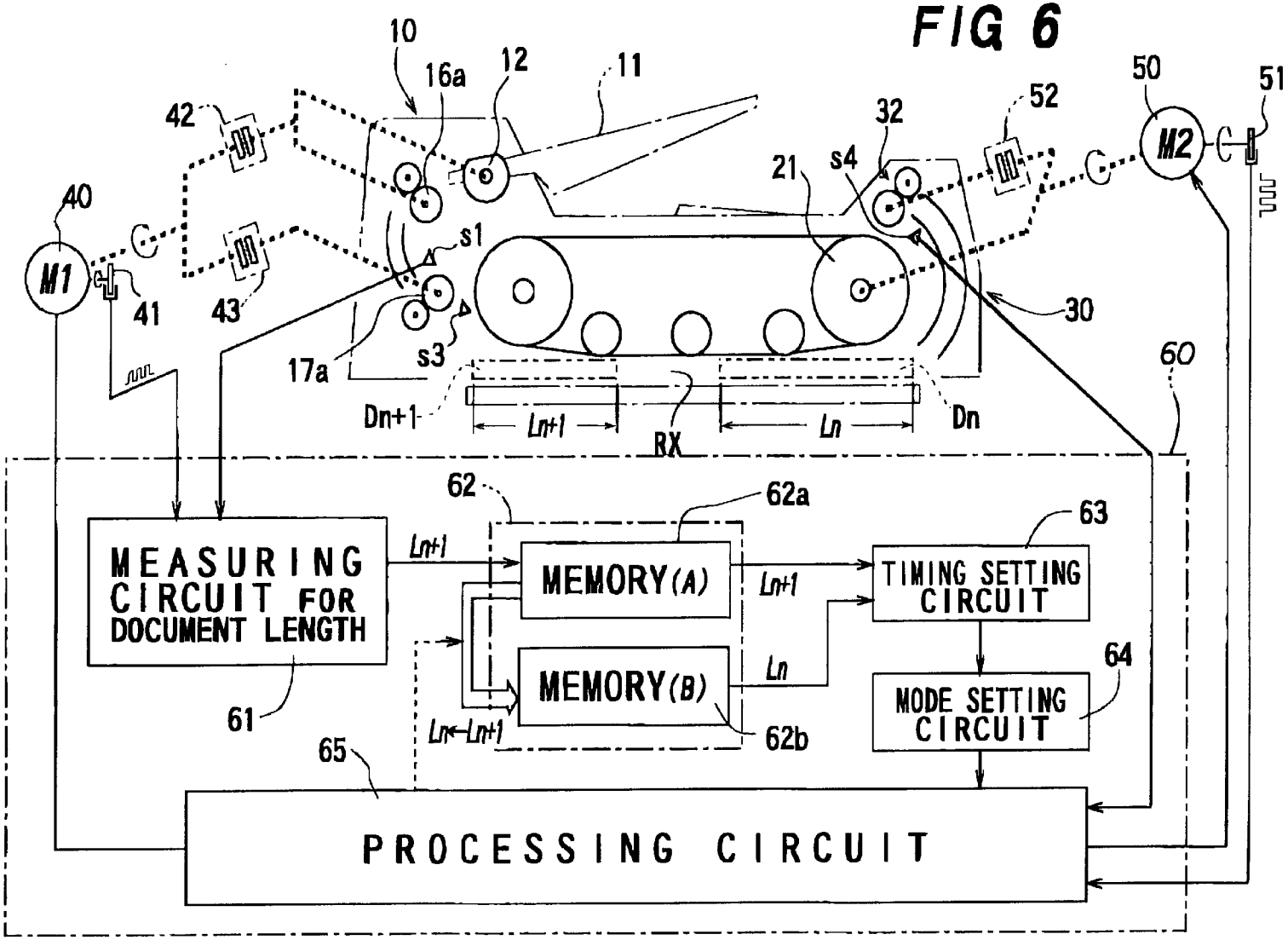
FIG. 6 is a block diagram schematically showing the device of FIG. 5 including a controlling system.

The kick roller 12, separation roller 16*a*, and register roller 17*a* are commonly driven by a document supplying driver 40 including a document supplying motor (M1) as shown in FIG. 6.

The motor 40 is provided on its rotary shaft with a rotation detector 41 such as a pulse generator or pulse encoder which generates pulses in accordance with the rotation of the motor, to measure the rotational momentum of the motor 40.

The motor 40 has an output rotary shaft connected with the separation roller 16*a* and the kick roller 12 through a one-way clutch 42 for transmitting the one-direction rotation made by the motor 40 to the separation roller and kick roller. Also, between the motor 40 and the register roller 17*a,* there is a one-way clutch 43 for transmitting the reverse rotation made by the motor 40 to the register roller 17*a*. Thus, either of the separation roller 16*a* and register roller 17*a* is driven to rotate as the motor 40 rotates.

The document transport unit 20 incorporates reversible driving roller 21 and driven roller 22, and reversible transport driving means 23 formed of at least one endless belt suspended between the driving and driven rollers, so that the transport driving means 23 comes into contact with the platen P when the document feeding device ADF is overlaid on the image processing device M.

Denoted by 25 in the drawings are press rollers for resiliently urging the transport driving means 23 against the platen P.

The document discharge passage R2 formed in the document discharging mechanism 30 is curved in an arch extending from the image scanning station RX beneath the transport unit 20 to the discharge tray 31. The discharge passage has a document exit port Ex confronting the discharge tray 31, near which a discharge sensor s4 is disposed for detecting the document to confirm the discharge of the document sent from the image scanning station, and document discharging means 32 formed of a discharge driving roller 32*a* and driven roller 32*b*.

The transport driving roller 21 of the transport unit 20 and the discharge driving roller 32*a* are driven in common by driving means 50 including a reversible document transporting motor (M2) as shown in FIG. 6.

The motor (driving means) 50 is provided on its rotary shaft with a rotation detector 51 such as a pulse generator or pulse encoder which generates pulses in accordance with the rotation of the motor, to measure the rotational momentum of the motor 50.

Between the motor 50 and the discharge driving roller 32*a,* there is incorporated a one-way clutch 52 for transmitting the one-direction rotation made by the motor 50 to the driving roller 32*a*. Thus, the transport driving roller 21 and the discharge driving roller 32*a* are driven to rotate as the motor 50 rotates in the forward direction. When the motor 50 is reversed, the transport driving roller 21 rotates in the reverse direction to move the document in the image scanning station in the reverse direction, but the discharge driving roller 32*a* stops rotating.

The controlling means 60 includes a document size measuring circuit 61 for measuring the lengths (Ln, Ln+1, . . .) of the documents Dn, Dn+1, . . . traveling along the supply passage R1 by taking count of pulses issued from the rotation detector 41 for finding the rotation of the motor 40, a memory means 62 for storing data signals representing the length of the document, which are issued from the measuring circuit 61, a timing setting circuit 63 for determining variable timing in accordance with the measured length of the document, a mode setting circuit 64 for selecting either of a switchback mode and a normal feed mode on the basis of the signals of the document lengths (Ln; Ln+1), which are respectively stored in a first memory 62 and a second memory 63 in the memory means 62, and a processing circuit 65 for driving and controlling the document supplying motor 40 and the document transporting motor 50 with document feed timing determined by a mode designating signal issued from the mode setting circuit 64.

The memory means 62 includes the first memory (A) 62*a* for storing the document length signals from the measuring circuit 61, and the second memory (B) 62*b* for storing the signals shifted from the first memory (A) 62, as shown in FIG. 6.

The timing sensor s3 is located at the document standby point in the vicinity of the image scanning station RX in the aforesaid document feeding device. The distance from the document standby point (s3) to the scanning reference point PX of the image scanning station RX is a known length Lw, and the distance from the scanning reference point PX to the discharging means 32 is a known length LX.

Figure 7:
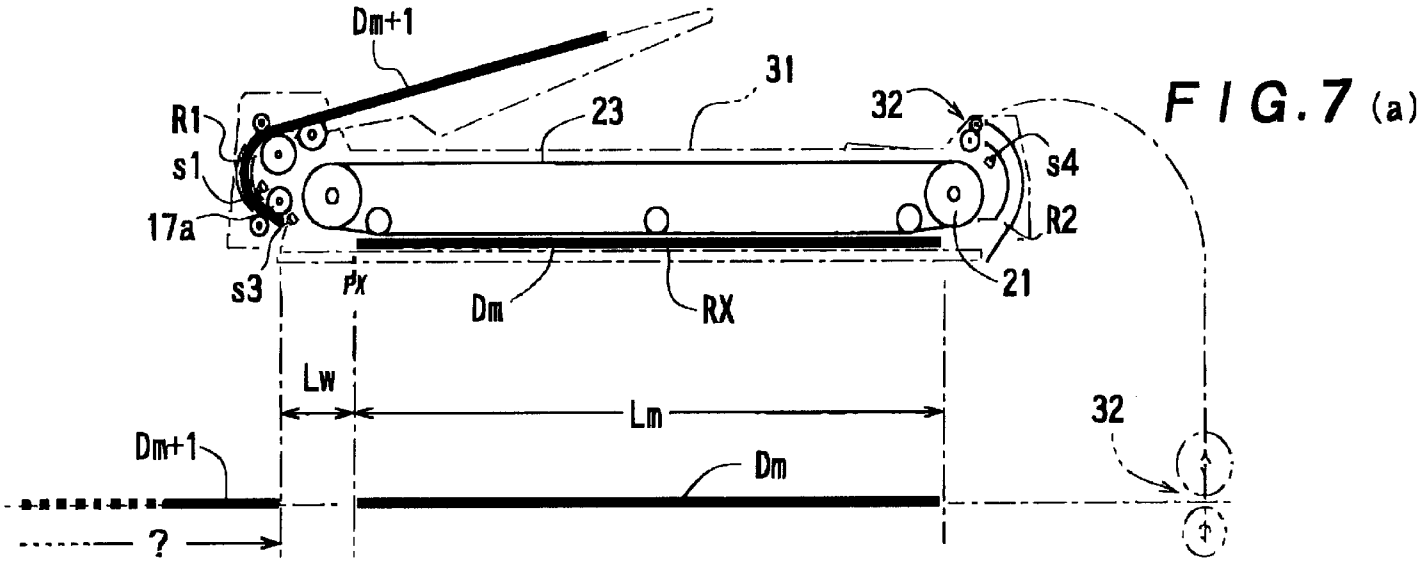
FIG. 7 is an explanatory diagram showing the basic concept of feeding documents with variable timing according to this invention.
Figure 7:
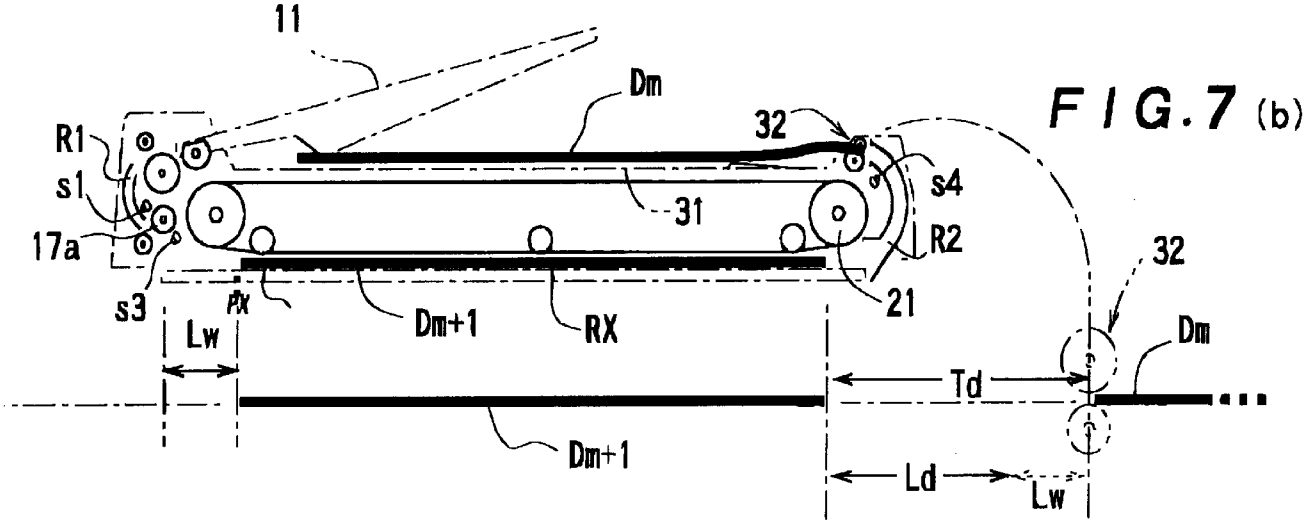

The timing setting circuit 63 of the controlling means 60 has a function of determining feeding-start timing for the following document Dn+1 in accordance with the length Ln of the preceding document Dn sent earlier. As shown in FIG. 7(*a*), the variable feeding-start timing is determined on the basis of the length Lm of the maximum document Dm which can be handled by the image processing device, so as to secure a document interval Td between the preceding document Dm completely discharged and the following document Dm+1 with the tail end positioned at the scanning reference point PX when the maximum documents are successively fed, as shown in FIG. 7(*b*).

That is, the document interval Td is the total of the leading length Lw from the document standby point (s3) to the scanning reference point PX and a delaying length Ld. The delaying length Ld varies with the length of the preceding document Dm (or Dn).

To be more specific, when the documents Dm and Dm+1 having the same length as the length Lm of the maximum document permitted by the image scanning station RX are handled in the system shown in FIG. 7(*a*), the following document Dm+1 sent later starts advancing after a prescribed time (corresponding to the length Ld) from the commencement of the discharging of the preceding document Dm sent earlier, so that the following document Dm+1 can successively arrive at the prescribed image scanning station, with the tail end thereof positioned at the scanning reference point PX at the time that the preceding document Dm is just discharged, as shown in FIG. 7(*b*). Thus, the preceding document sent earlier can be changed by the following document sent later in a shortest time for transporting the document having maximum size Lm without unnecessary loss of time. Namely, the standby point s3 is close to the scanning reference point PX to effectively make the interval Td short, consequently to shorten the time required for transporting the documents.

The system adopting the delaying length Ld further serves a function of effectively feeding the documents of different lengths. That is, the length of the following document Dm+1 is not yet known at the time of FIG. 7(*a*), and may possibly be small in size. The same is true of the case where both the preceding and following documents are smaller than the document having the maximum length Lm, as shown in FIG. 8.

Figure 8:
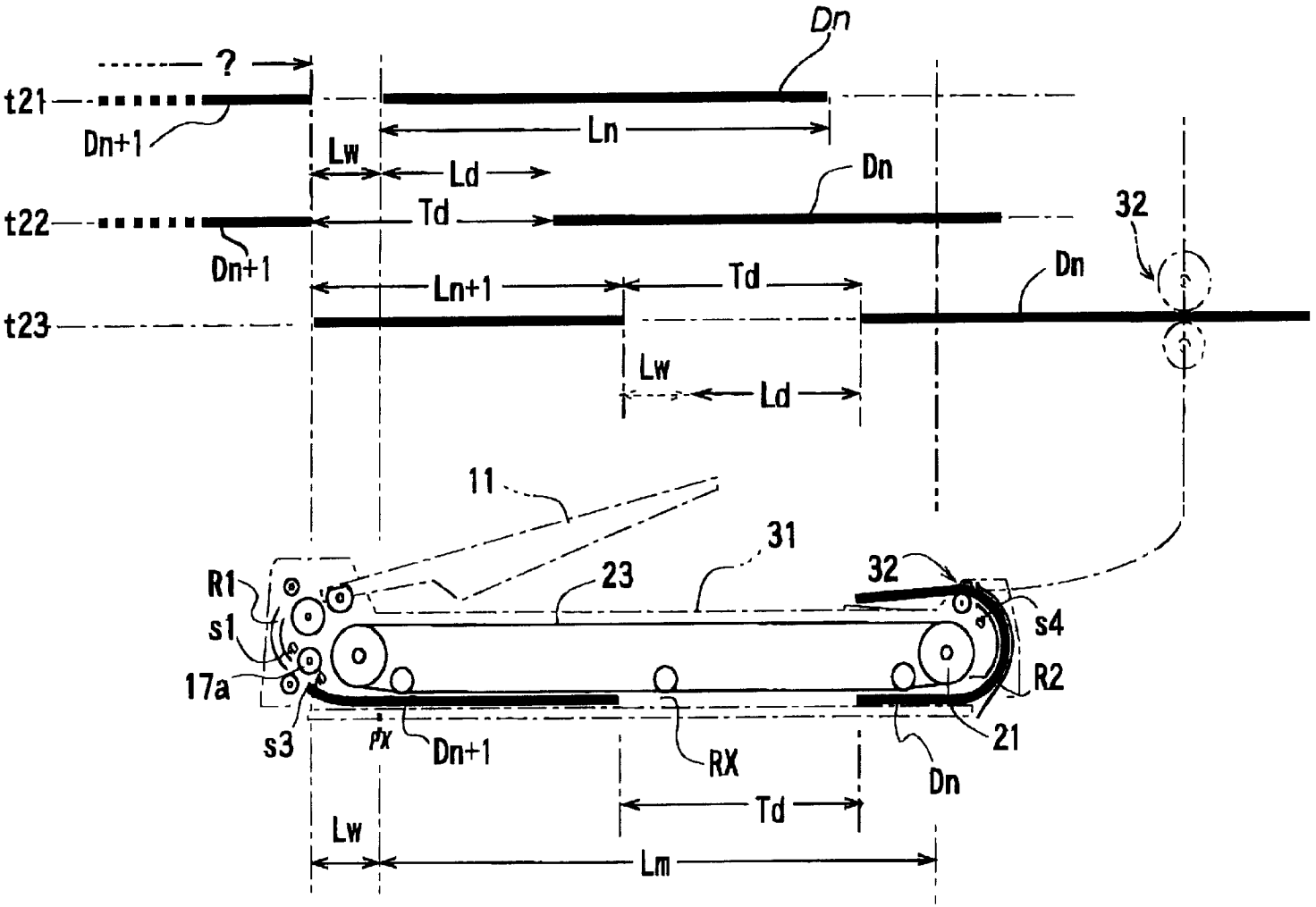
FIG. 8 is an explanatory diagram showing the principle of feeding the documents with variable timing determined for documents different in size according to this invention.
Figure 9A:
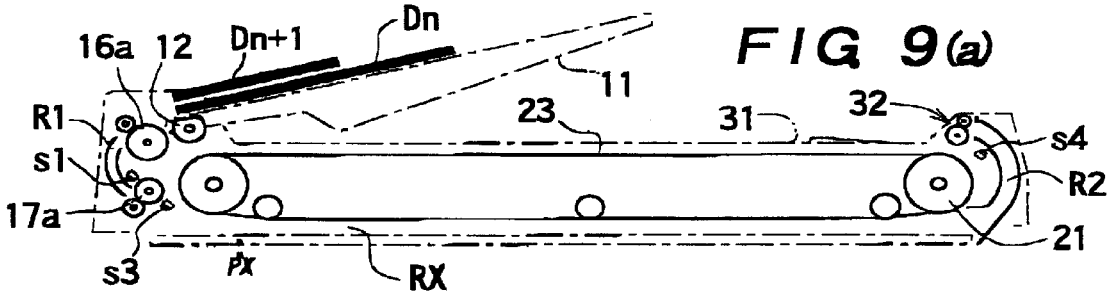
FIG. 9(*a*) through FIG. 9(*j*) are explanatory diagrams showing the sequence of operation in feeding the documents according to the automatic document feeding device and method of the present invention.
Figure 9B:
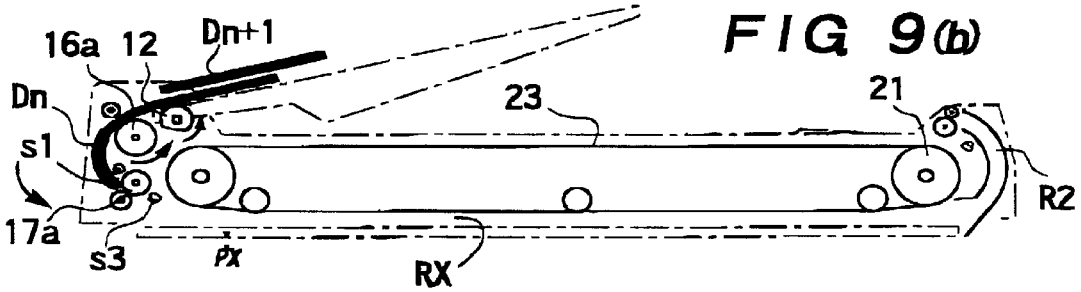
Figure 9C:
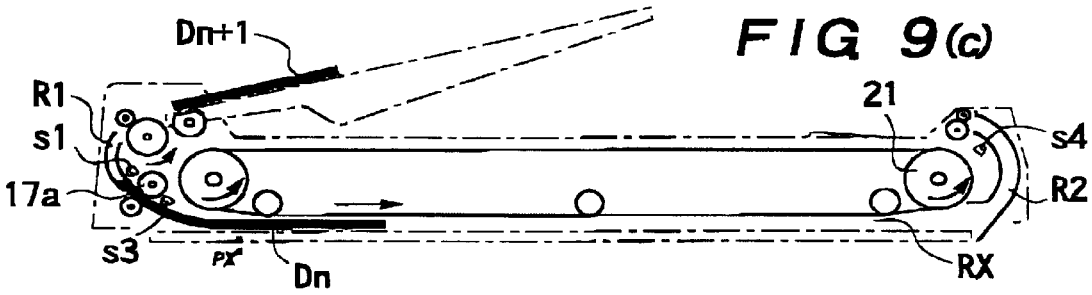
Figure 9D:
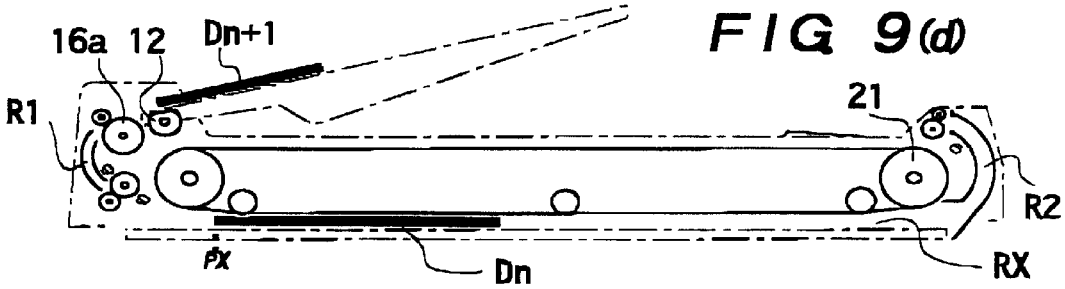
Figure 9E:
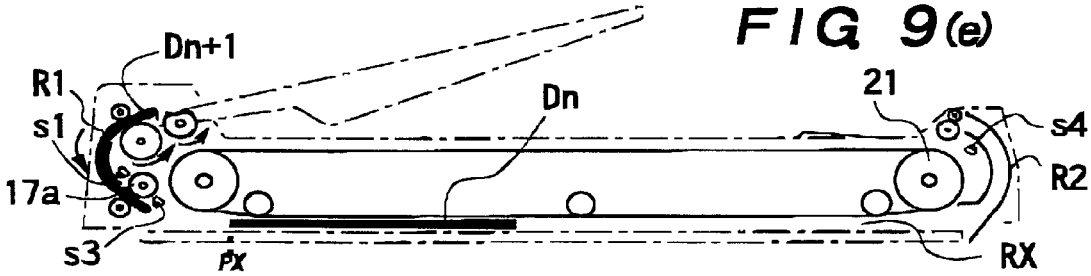
Figure 9F:
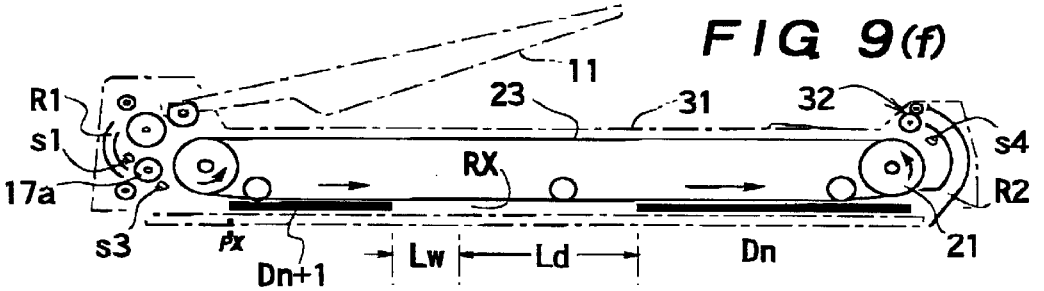
Figure 9G:
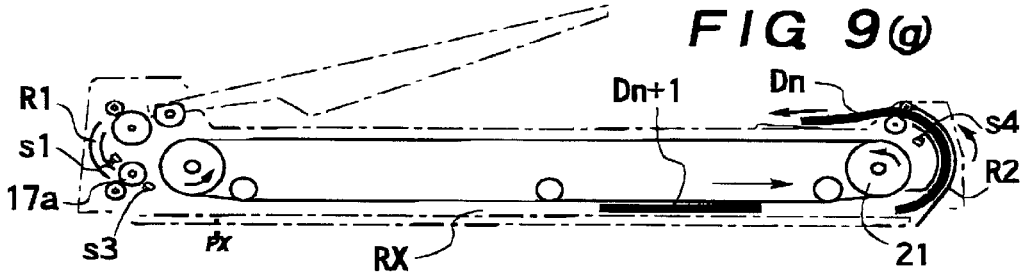
Figure 9H:
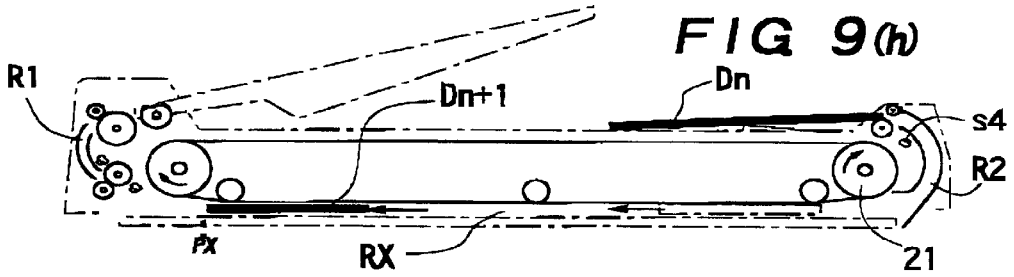
Figure 9I:
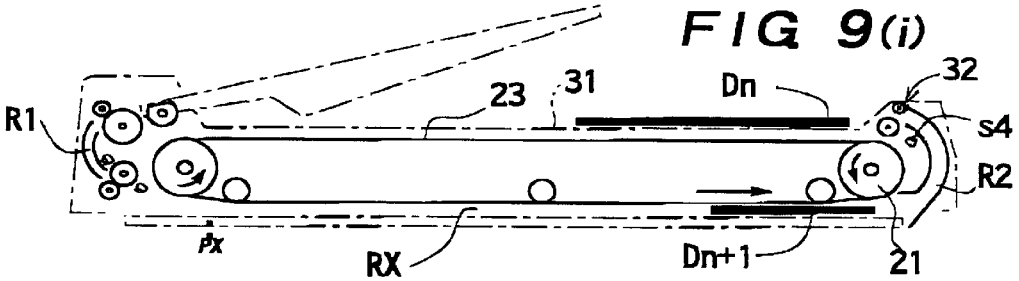
Figure 9J:
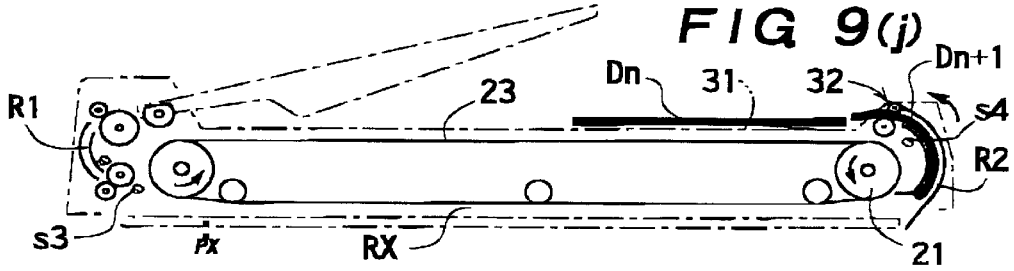

In FIG. 8, the length Ln of the document Dn being treated at the image scanning station RX has been already known by means of the measuring circuit 61 at this time, but the length of the following document Dn+1 waiting at the standby point s3 is not yet found at the time t21.

At the time that the delay time corresponding to the delaying length Ld passes from the commencement of the discharging of the preceding document Dn after being scanned, the following document Dn+1 starts advancing (t22). Namely, the document interval Td between the preceding document Dn and the following document Dn+1 corresponds to the total of the leading length Lw and the delaying length Ld.

At the time t23, the length Ln+1 of the following document Dn+1 is measured by the measuring circuit 61, consequently to recognize that the following document Dn+1 is smaller than that of the maximum length Lm.

At the time of finding that the following document Dn+1 is smaller than that of the maximum length Lm, the mode setting circuit 64 designates the switchback mode. the following document Dn+1 is sent back to the scanning reference point PX after the preceding document Dn is discharged.

Figure 10:
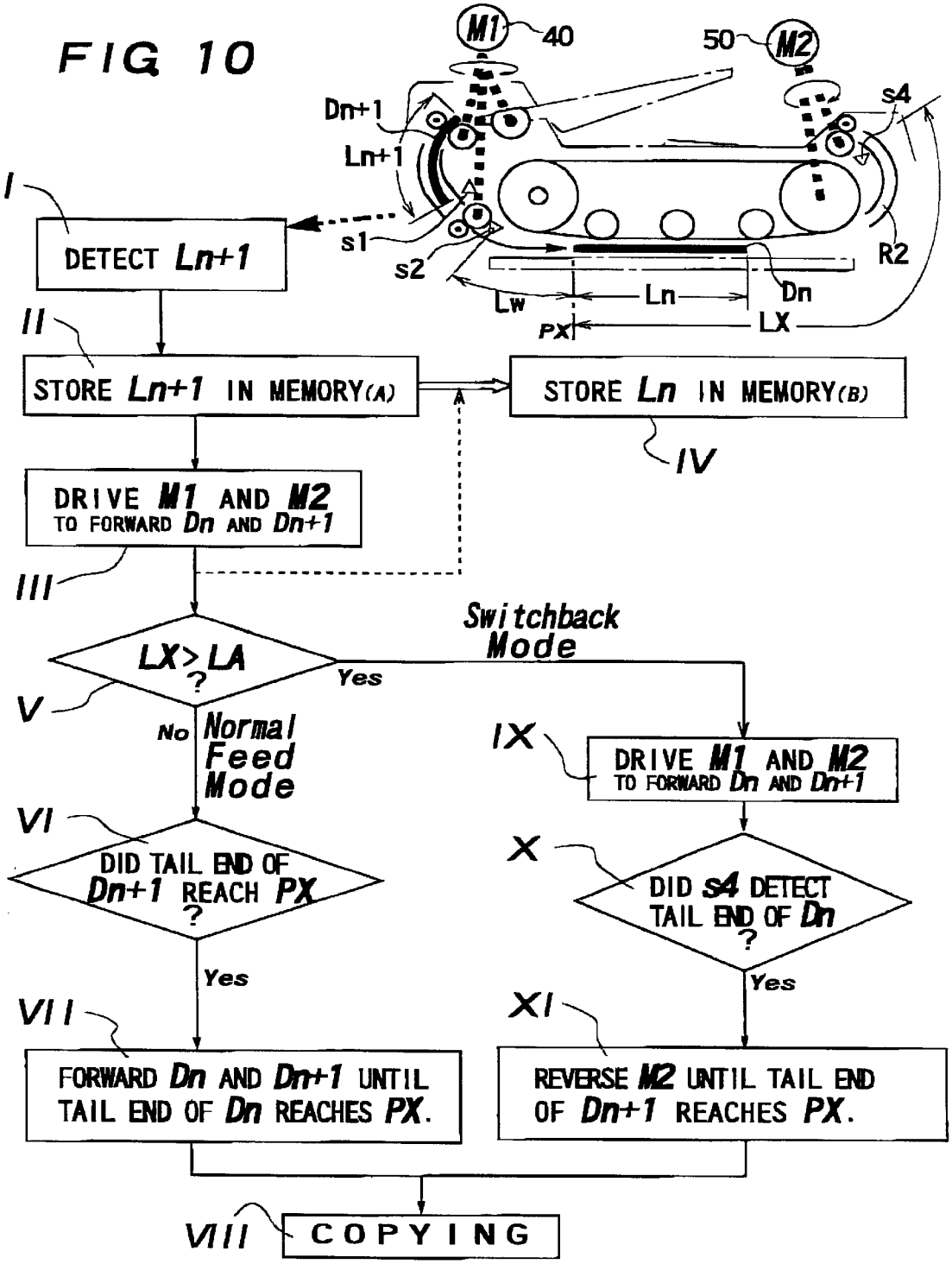
FIG. 10 is a flowchart explanatory of the operation of the principal portions of the device and method according to this invention.

The manner for designating the switchback mode or the normal feed mode will be described with reference to FIGS. 9(*a*) to (j) and FIG. 10.

Prior to the image processing, a plurality of documents are stacked on the supply tray 11. In the drawings are shown only two of the document Dn numbered "n" and the following document Dn+1 numbered "n+1" to be fed for being scanned, assuming that the "n" numbered document Dn is larger than the "n+1" numbered document (following document) Dn+1, for brevity's sake.

When the empty sensor 13 detects the documents stacked on the supply tray 11, the motor (M2) 50 rotates for a prescribed period in the forward direction to drive the transport unit 20 and the discharging mechanism 30 in the forward direction to discharge a remaining document, if any. This is a preliminary operation for discharging the document possibly left accidentally in the image scanning portion RX or the discharge passage R2 in the discharging mechanism 30.

Next, when giving an image processing instruction to the image processing device, the gate means 14 is released, and the supplying motor (M1) 40 rotates in the forward direction to drive the kick roller 12 for sending off one document Dn from the supply tray 11. At this time, since the motor 40 rotates forwardly, the one-way clutch 42 assumes its joined state to drive the separation roller 16*a,* but the one-way clutch 43 assumes its disconnected state to bring the register roller 17*a* to a rest.

When the leading end of the document Dn being forwarded along the supply passage R1 by the separation rollers 16*a* and 16*b* is detected by the document sensor s1, the motor 40 is reversed after a prescribed delay time passes. The delay time is determined by a period until the document Dn softly collides at its leading end with the register rollers 17*a* and 17*b*, consequently to bend slightly as shown in FIG. 9(*b*). As a result, even if the document Dn moves in a slant posture, it is cured to assume its correct posture directed straight in the forward direction due to the collision with the register rollers 17*a* and 17*b* (skew correction).

After the prescribed delay time passes, the document supplying motor 40 is reversed, as a result of which the one-way clutch 19*b* is disconnected to bring the separation roller 16*a* to a free rotation state, and simultaneously, the one-way clutch is joined to rotate the register roller 17*a,* thus forwarding the document Dn beyond the register rollers 17*a* and 17*b.* In the case where the document Dn is the first document, it is forwarded without stopping at the standby point defined at the timing sensor s3.

While the document passes through the register rollers 17*a* and 17*b,* the document size measuring circuit 61 takes count of pulses issued from the rotation detector 19*a* mounted on the motor 40, and stops counting the pulses when the sensor s1 detects the tail end of the document Dn, as shown in FIG. 9(*c*). Based on the measured pulses, the size (length Ln) of the document Dn can be measured (Step I in FIG. 10). The length Ln thus measured is stored in the first memory (A) 62 (Step II).

In the case where the document Dn is the first document, the motor 40 further rotates by a prescribed rotation after the tail end of the document is detected by the timing sensor s3, to move the document forwardly by the leading length Lw. Consequently, the document Dn stops at the image scanning station, with the tail end positioned at the scanning reference point PX as shown in FIG. 9(*d*), and then, undergoes the desired image processing by operating the image processing device M.

While performing the image processing by the image processing device M, the document Dn+1 to be treated next time is transported by actuating the supplying mechanism 10 including the kick roller 12, separation rollers 16*a* and 16*b,* and register rollers 17*a* and 17*b* in the same manner as described above, and then, stops with the leading end positioned at the standby point (s3), so that the document Dn+1 stands ready for the next image processing as shown in FIG. 9(*e*).

When the desired image processing of the preceding document Dn is completed, the transporting motor 50 starts rotating in the forward direction to send out the preceding document Dn. As described above, when the delay time corresponding to the length Ld determined according to the length of the preceding document Dn passes, the supplying motor 40 starts rotating in the forward direction to forward the following document Dn+1. Thus, the preceding document Dn and the following document Dn+1 are sent in the forward direction along the image scanning station RX (Step III).

When the following document Dn+1 passes by the document sensor s1, the length Ln+1 thereof is measured on the basis of the rotation of the motor 40 by the rotation detector 41, and stored in the first memory (A) 62. When storing data of the length Ln+1 of the following document Dn+1 in the first memory (A) 62, the data of the length Ln of the preceding document Dn which were already stored in the first memory are shifted to the second memory (B) 63 (Step IV).

Figure 11:
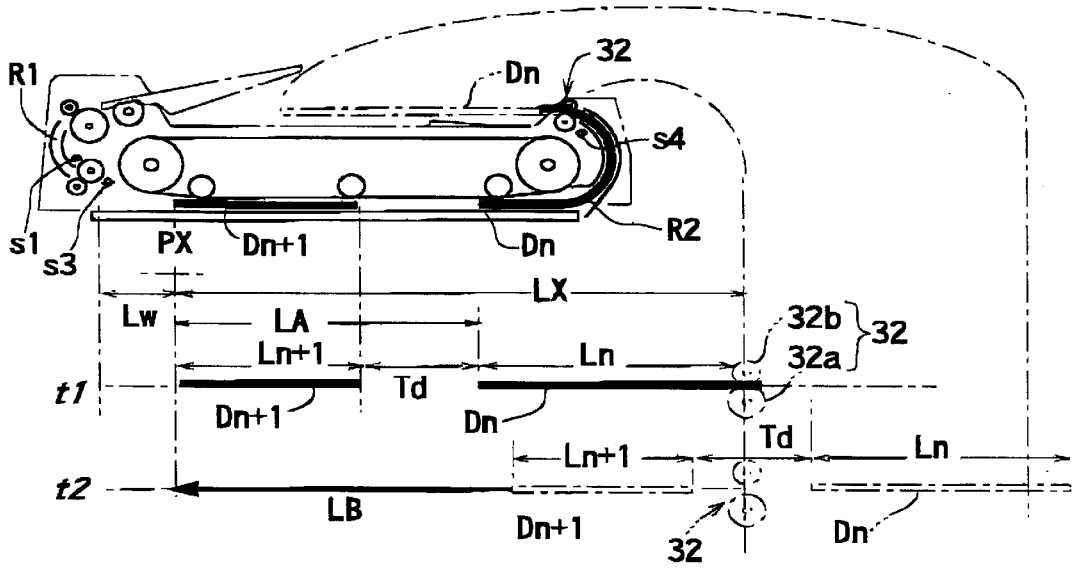
FIG. 11 is an explanatory diagram showing the operation of feeding the document according to the first embodiment of this invention.

At this time, when the total LA [=(Ln+1)+Td] of the length Ln+2 of the following document Dn+1 and the aforementioned document interval Td (Lw+Ld) is smaller than the transport length LX from the scanning reference point PX to the discharging means 32 (LX>LA) as seen at the time t32 in FIG. 11, the mode setting circuit 64 designates the "switchback" mode. When the total length LA is equal to or larger than the transport length LX, the "normal feed" mode is designated (Step VI).

The transporting motor 50 continues rotating in the forward direction to move the documents Dn and Dn+1 along the image scanning station RX in the forward direction (FIG. 9(*f*)).

In the "normal feed" mode, at the time that the tail end of the following document Dn+1 reaches the scanning reference point PX (Step VI), the preceding document Dn is completely discharged through the discharge passage R2, and the following document Dn+1 stops at the image scanning station RX (Step VII), and undergoes the desired image processing such as copying by operating the image processing system M (Step VIII).

In the "switchback" mode, even when the preceding document Dn enters the discharge passage R2 and is partially discharged to the discharge tray 31 as shown in FIG. 9(*g*), the documents Dn and Dn+1 are continuously forwarded (Step IX). During this period, the movements of the documents are being observed by the rotation detectors 41 and 51 of the motors 40 and 50, so that the position of the tail end of the following document Dn+1 relative to the scanning reference point PX can be recognized.

When the tail end of the document Dn advancing along the discharge passage R2 is detected by the discharge sensor s4 (Step X), namely, when the document Dn is completely discharged to the discharge tray 31, the motor 50 is reversed (Step XI).

With the reverse rotation of the motor 50, the discharge driving roller 32*a* is stopped by the one-way clutch 52, but the transport driving means 23 is driven in the reverse direction to send back the document Dn+1 left in the image scanning station RX toward the scanning reference point PX.

The switchback length LB by which the document Dn+1 should be sent back is obtained by subtracting the total of the length Ln+1 of the document Dn+1 and the document interval Td from the transport length LX, and can be calculated by the processing circuit 65. However, since the rotation detector 51 observes whether or not the tail end of the document Dn+1 arrives at the scanning reference point PX, the arrival of the tail end of the document Dn+1 at the point PX can be foreseen. Then, when the document Dn+1 reaches the scanning reference point PX, the motor 50 is stopped. Thus, the document Dn+1 takes the prescribed image scanning position as shown in FIG. 9(*h*), and undergoes the desired image processing (Step VIII).

The document Dn+1 after being scanned is sent out from the image scanning station RX into the discharge passage R2 by driving the transport driving means 23 and the discharging means 32 with the forward rotation of the motor 50. Then, the document Dn+1 is discharged from the discharge passage R2 to the discharge tray 31 as shown in FIG. 9(*j*).

In a case where a document Dn+2 is remained on the supply tray at the time of processing the document Dn+1 at the image scanning station RX as shown in FIG. 9(*h*), the same manner as above may be repeated from the process shown in FIG. 9(*d*), upon suppositionally replacing the documents Dn+1 and Dn+2 with the documents Dn and Dn+1, respectively, for convenience' sake.

As is described above, even in the case where the documents to be processed are smaller in length than the length of the image scanning station RX, the time required for consecutively feeding the documents can be drastically shortened, but what should be more noted is the fact that the device according to the invention is remarkably effective in shortening the time required for handling the documents having small difference in size relative to the document having the maximum length Lm. In particular, a conventional document feeding method calls for a complicated controlling system to rationally feed the documents different in size. However, according to the document feeding method of the present invention, a high-performance document feeding system can be readily accomplished by simply modifying an existing controlling system for use in a common document feeding system.

Figure 12:
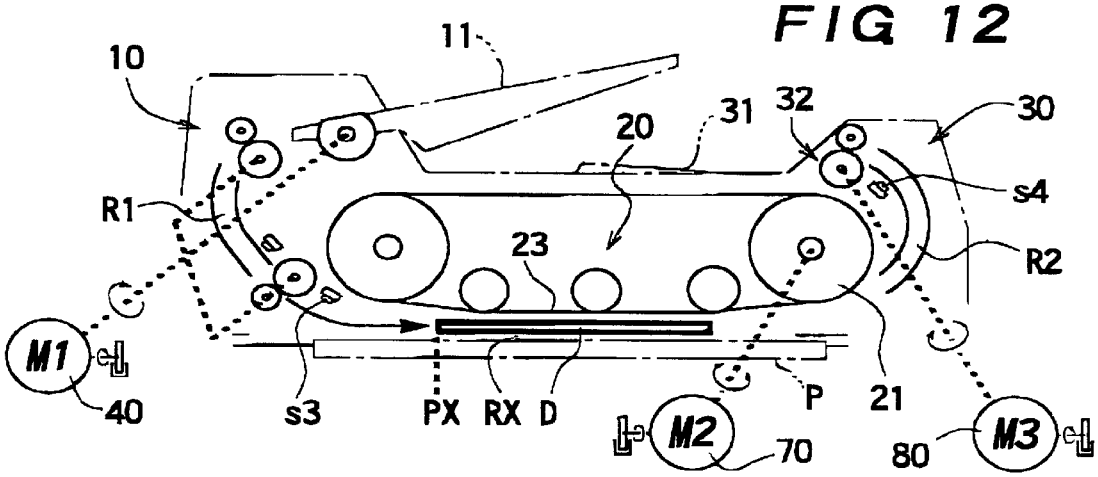
FIG. 12 is an explanatory diagram schematically showing the second embodiment of this invention.

That is to say, the aforementioned first embodiment has a simple and rational structure constituted by the single motor 40 for actuating the document supplying mechanism 10, and the single motor 50 for actuating the transport unit 20 and the discharging mechanism 30 in common. But, the document feeding can be more rationally carried out by using document transport driving means 70 and document discharge driving means 80, which include independent motors (M2 and M3) for the transport unit 20 and the discharging mechanism 30 as shown in FIG. 12 as a second embodiment. In a word, this second embodiment is constructed by adding the discharge driving means 80 to the transport driving means 50 in the foregoing first embodiment (which corresponds to the means 70 in this embodiment).

The second embodiment will be described in more detail with reference to FIG. 13(*a*) to FIG. 13(*c*). The initial process of transporting the preceding document Dn and the following document Dn+1 is the same as the process till FIG. 9(*f*) in the aforesaid first embodiment using two motors. Since the elements depicted by the same reference numbers with respect to those of the first embodiment are equivalent to those of the first embodiment and will not be described in detail again.

After the preceding document Dn is treated at the image scanning station RX as shown in FIG. 9(*e*), it is sent out from the image scanning station RX and forwarded along with the following document Dn+1 as shown in FIG. 9(*f*). During the forwarding operation, the transport driving means 70 and the driving means 80 are together driven to rotate in the forward direction, as shown in FIG. 13(*a*).

When the leading end of the preceding document Dn traveling along the discharge passage R2 is nipped by the discharging means 32, the transporting motor (M2) 70 is reversed, but the discharging motor (M3) 80 continues rotating in the forward direction. As a result, the preceding document Dn is discharged to the discharge tray 31, and the following document Dn+1 is positioned at the image scanning station with the tail end positioned at the scanning reference point PX, as shown in FIG. 13(*b*). The tail end of the following document Dn+1 arrives at the scanning reference point PX in the same manner as that shown in FIG. 9(*h*).

Figure 13A:
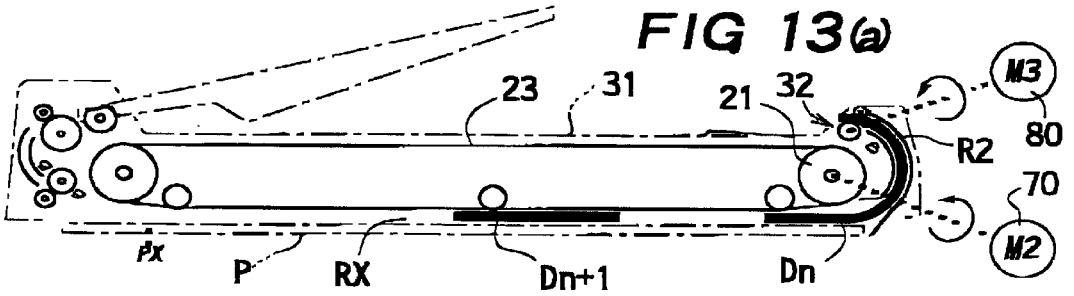
FIG. 13(*a*) through FIG. 13(*c*) show the sequence of operation in feeding the document in the device shown in FIG. 12.
Figure 13B:
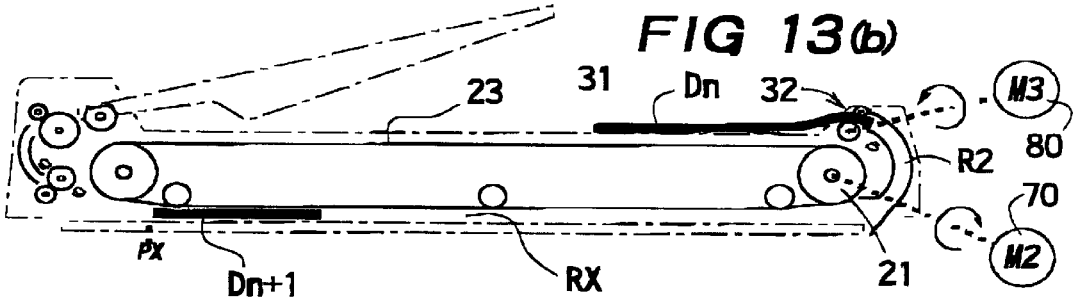
Figure 13C:
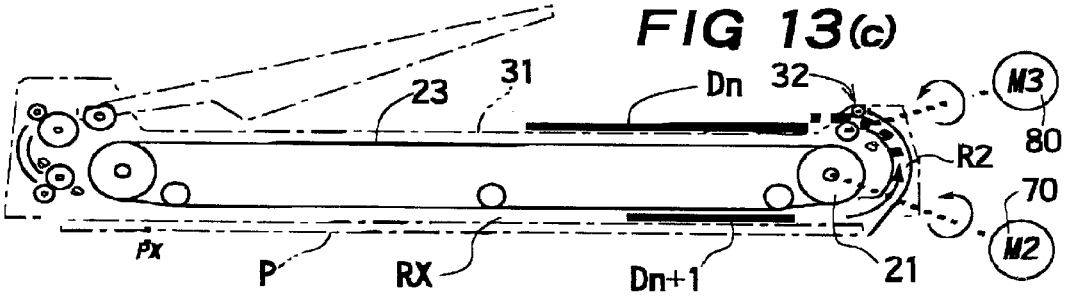

Upon completion of the image processing or copying at the scanning reference point PX, the transporting motor (M2) is driven in the forward direction to send out the document Dn+1 to the discharge tray 31 through the discharge passage R2, as shown in FIG. 13(*c*).

In this embodiment, the document feed timing is determined so as to secure the document interval Td between the preceding document Dn nipped by the discharging means 32 and the following document Dn+1 having the tail end positioned at the scanning reference point PX.

To be more specific, in this second embodiment, at the time that the leading end of the preceding document Dn to be discharged reaches the discharging means 32, the following document Dn+1 is moved backward. That is, the switchback length LB in this embodiment is equal to the length obtained by subtracting the total length LA [=Ln+(Ln+1)+Td] of the document interval Td, the length Ln of the preceding document Dn and the length Ln+1 of the following document Dn+1 from the transport length LX including the discharge passage R2.

Figure 14:
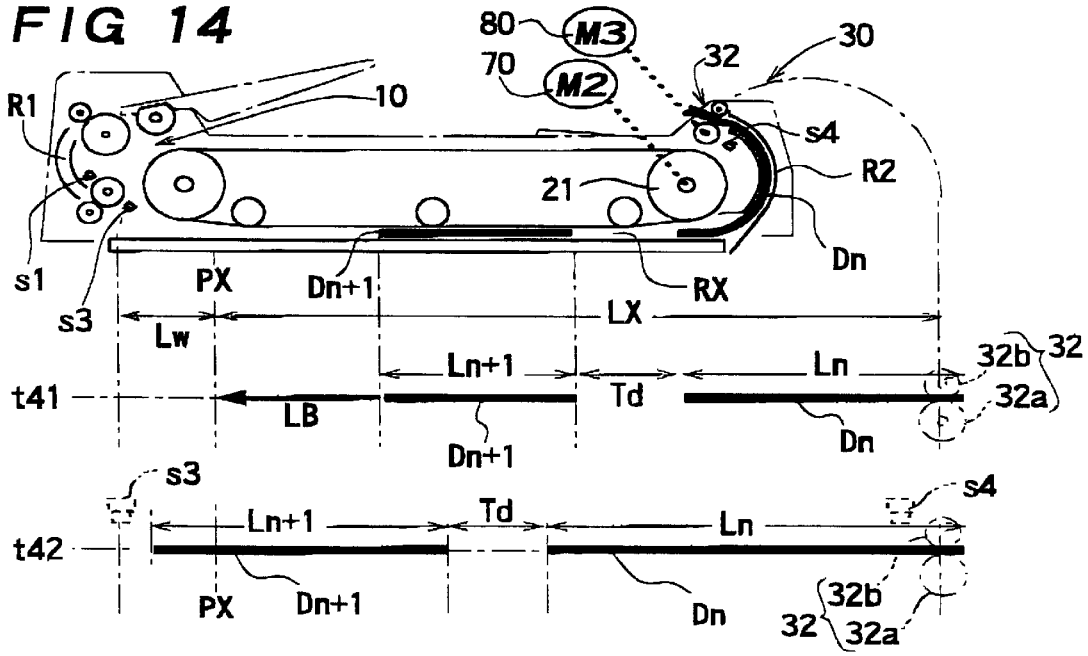
FIG. 14 is an explanatory diagrams showing one example for feeding the documents by using the device of FIG. 12.

To sum up, although the switchback length LB in the foregoing first embodiment employing two driving motors is obtained by subtracting the total of the length Ln+1 of the document Dn+1 and the document interval Td from the transport length LX, the switchback length in this embodiment employing three motors is obtained by subtracting the length [Ln+(Ln+1)+Td] form the transport length LX. This will be easily understood by comparing the switchback length LB shown in FIG. 11 with that shown in FIG. 14.

In conclusion, the length by which the preceding document should be moved can be shortened to make the processing time short in the device using three motors in comparison with that using two motors.

Both the first and second embodiments have a function of selecting "normal feed" mode in the case where the total length of the document interval Td, the length Ln of the preceding document Dn and the length Ln+1 of the following document Dn+1 is larger than the transport length LX, so that the reverse movement of the following document Dn+1 can be left out.

Since the leading length Lw and the transport length LX are previously known as fixed values (constants), numeric value setting and calculating operations can be executed with ease. However, the numeric values to be determined for performing the desired document feeding may be variable, so that the document feeding device of the invention is readily applicable to the existing image processing system of any type.

As is apparent from the foregoing description, according to the document feeding device of the present invention capable of feeding the documents with variable timing in accordance with the sizes of the documents, the documents can be rationally and stably fed to and discharged from the image scanning station defined on the image processing system at high speed by use of a simple controlling system and driving mechanisms. Furthermore, the document feeding device of the invention can recognize the size or length of the document to be scanned, so as to rationally perform the document feeding and discharging operation even when handling documents having different sizes.

Besides, according to this invention, at the time of treating the preceding document, the following document is positioned at the standby point in the vicinity of the image scanning station at which the preceding document is placed for being scanned, and then, starts to move from the standby point to the image scanning station as the size of the document is measured while the preceding document is sent off the image scanning station upon the completion of the desired image processing, consequently to increase the document feeding speed. The device according to this invention further has a beneficial effect of being versatilely applicable to various image processing devices such as a copying machine, facsimile and image scanner with ease.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An automatic document feeding device for feeding and discharging documents one by one to and from an image scanning station having a document supply side with a scanning reference point, which comprises:

a document supplying mechanism for stacking one or more documents having respective lengths and sending the documents one by one to said image scanning station through a supply passage;

measuring means disposed on said supply passage for measuring the length of the document passing through said document supplying mechanism;

a document transport unit for allowing the document fed from the document supplying mechanism to be moved along said image scanning station selectively in either of a forward direction or a reverse direction so as to position said document at said scanning reference point;

a document discharging mechanism having a discharge passage through which the document is discharged from the image scanning station; and means for controlling transporting of the document in accordance with the lengths of preceding and following documents measured by said measuring means.

2. An automatic document feeding device for feeding and discharging documents one by one to and from an image scanning station having a scanning reference point, which comprises a document supply passage through which one or more given documents having respective lengths are fed one by one to said image scanning station, said given documents including a preceding document to be sent earlier and a following document to be sent later, a document supplying mechanism incorporating means for measuring the length of the document traveling along said document supply passage, a document transport unit for moving the document fed from the document supplying mechanism along said image scanning station selectively in either of a forward direction or a reverse direction so as to position said document at said scanning reference point, a document discharging mechanism having a discharge passage through which the document is discharged from the image scanning station, and discharging means disposed is on said discharge passage, and means for controlling said document supplying mechanism, discharging mechanism and said document transport unit so as to transport the document fed to said image scanning station in accordance with the length of the document measured by said measuring means, wherein said given documents are consecutively introduced in succession into said image scanning station in such a manner that said preceding document fed into said image scanning station is discharged, after being treated, by driving said document transport unit and said discharging mechanism in a forward direction, and simultaneously, said following document is transported by driving said supplying mechanism with document feed timing determined in accordance with the length of said preceding document, wherein said following document which passes past said scanning reference point when said preceding document is completely discharged is moved backward by reversing said document transport unit to be positioned at said scanning reference point.

3. An automatic document feeding device for feeding and discharging documents one by one to and from an image scanning station having a scanning reference point, which comprises:

a document supplying mechanism for stacking one or more given documents having respective lengths and sending the given documents one by one to said image scanning station through a supply passage in which a document standby point is defined, and including means for measuring the length of the document moving along said supply passage, said given documents including a preceding document to be sent earlier and a following document to be sent later, a document transport unit for moving the document fed from the document supplying mechanism along said image scanning station selectively in either of a forward direction or a reverse direction so as to position said document at said scanning reference point, a document discharging mechanism having a discharge passage through which the document is discharged from the image scanning station, and discharging means disposed on said discharge passage, and means for controlling said document supplying mechanism, discharging mechanism and said document transport unit so as to move the document fed to said image scanning station in accordance with the length of the document measured by said measuring means, wherein said given documents are consecutively introduced in succession into said image scanning station in such a manner that, while treating said preceding document at said image scanning station, said following document is sent and made wait at said standby point until said preceding document is sent out from said image scanning station after being treated, and introduced into said image scanning station with a delay time determined in accordance with the length of said preceding document so as to be moved in the forward direction by a length interval determined by a leading length from said standby point to said scanning reference point, while discharging said preceding document from said image scanning station, wherein said following document is moved backward by reversing said document transport unit to be positioned at said scanning reference point upon discharging said preceding document in a case where a total of said length interval and said length of said following document measured by said measuring means are shorter than said leading length.

4. The automatic document feeding device according to claim 3, wherein said document supplying mechanism is driven by one document supply driving means, and said document transport unit and said document discharging mechanism are driven by one common reversible transport driving means.

5. The automatic document feeding device according to claim 4, wherein said document supplying mechanism is provided with a document sensor for detecting the document traveling along said supply passage, and said document supply driving means and said reversible transport driving means are constituted by respective motors each having a rotation detector, so that the length of the document moving along said supply passage is measured based on a signal issued from said rotation detector of said document supplying mechanism by using said document sensor.

6. An automatic document feeding device for feeding and discharging documents one by one to and from an image scanning station having a scanning reference point, which comprises:

a document supplying mechanism for stacking one or more given documents having respective lengths and sending the documents one by one to said image scanning station through a supply passage in which a document standby point is defined, and including means for measuring the length of the document moving along said supply passage, said given documents including a preceding document to be sent earlier and a following document to be sent later, a document transport unit for moving the document fed from the document supplying mechanism along said image scanning station selectively in either of a forward direction or a reverse direction so as to position said document at said scanning reference point, a document discharging mechanism having a discharge passage through which the document is discharged from the image scanning station, and discharging means disposed on said discharge passage, and means for controlling said document supplying mechanism, discharging mechanism and said document transport unit so as to move the document fed to said image scanning station in accordance with the length of the document measured by said measuring means, wherein said given documents are consecutively introduced in succession into said image scanning station in such a manner that, while treating said preceding document at said image scanning station, said following document is sent to and made wait at said standby point until said preceding document is sent out from said image scanning station after being treated, and introduced into said image scanning station with a delay time determined in accordance with the length of said preceding document so as to be moved in the forward direction by a length interval determined by a leading length from said standby point to said scanning reference point, while discharging said preceding document from said image scanning station, wherein said following document is moved backward by reversing said document transport unit to be positioned at said scanning reference point when said preceding document arrives at said discharging means, and simultaneously said preceding document is continuously moved to be discharged, in a case where a total of said length interval, the length of said preceding document and the length of said following document are shorter than said leading length.

7. The automatic document feeding device according to claim 6, wherein said document supplying mechanism is driven by one document supply driving means, said document transport unit is driven by one reversible document transport driving means, and said document discharging mechanism is driven by one discharge driving means.

8. The automatic document feeding device according to claim 7, wherein said document supplying mechanism is provided with a document sensor for detecting the document traveling along said supply passage, and said document supply driving means, reversible transport driving means and discharge driving means are constituted by respective motors each having a rotation detector, so that the length of the document moving along said supply passage is measured based on a signal issued from said rotation detector of said document supplying mechanism by using said document sensor.

9. An automatic document feeding device for automatically feeding and discharging documents one by one to and from an image scanning station having a scanning reference point, which comprises:

a document supplying mechanism including a document supply tray for stacking one or more given documents having respective lengths, a supply passage for sending the documents stacked on said supply tray one by one to said image scanning station, and means for measuring the length of the document moving along said supply passage, said given documents including a preceding document to be sent earlier and a following document to be sent later, a document supply driving means for driving said document supplying mechanism, said driving means including a rotation detector for measuring movement of the document being transported along said supply passage, a document transport unit for moving the document fed from the document supplying mechanism along said image scanning station selectively in either of a forward direction or a reverse direction so as to position said document at said scanning reference point, a document discharging mechanism including a discharge passage through which the document is discharged from the image scanning station, discharging means disposed on said discharge passage, and a discharge tray for receiving the document sent out from said discharge passage, means for controlling said document supplying mechanism, discharging mechanism and said document transport unit so as to move the document fed to said image scanning station in accordance with the length of the document measured by said measuring means, said controlling means including memory means for storing said length of the document measured by said measuring means, and at least one driving means for driving said document transport unit and said discharging mechanism, said at least one driving means each having a rotation detector for measuring movement of the document being transported by said document transport unit and said discharging mechanism, wherein said given documents are consecutively introduced in succession into said image scanning station in such a manner that said preceding document fed into said image scanning station is discharged, after being treated, by driving said document transport unit and said discharging mechanism in the forward direction, and simultaneously, said following document is transported by driving said supplying mechanism at a length interval determined by a delay time in accordance with the length of said preceding document, wherein said following document which passes past said scanning reference point when said preceding document is completely discharged is moved backward by reversing said document transport unit to be positioned at said scanning reference point.

10. An automatic document feeding method for feeding and discharging documents including a preceding document to be sent earlier and a following document to be sent later one by one to and from an image scanning station having a scanning reference point by use of a document feeding device comprising a document supplying mechanism for stacking one or more documents having respective lengths and sending the documents one by one to said image scanning station through a supply passage, a document transport unit for moving the document fed from said document supplying mechanism relative to said image scanning station, and a document discharging mechanism for discharging the document sent by said document transport unit, which comprises:

measuring the length of the preceding document being transported to said image scanning station along said supply passage, sending the following document toward said image scanning station along said supply passage in said document supplying mechanism while treating said preceding document at said image scanning station, sending off said preceding document after treated in a forward direction, and simultaneously, forwarding said following document toward said image scanning station with variable timing determined by a delay time in accordance with the length of said preceding document, measuring the length of said following document moving along said supply passage in said document supplying mechanism, moving said following document backward to said scanning reference point in a case where said following document passes past said scanning reference point when said preceding document is discharged from said discharging mechanism, moving said following document forward to said scanning reference point in a case where said following document does not reach scanning reference point when said preceding document is discharged from said discharging mechanism, and discharging said following document after treated at said image scanning station from said image scanning station through said discharging mechanism.

11. An automatic document feeding method for feeding and discharging documents including a preceding document to be sent earlier and a following document to be sent later one by one to and from an image scanning station having a scanning reference point by use of a document feeding device comprising a document supplying mechanism incorporating a supply tray for stacking one or more documents having respective lengths, and a supply passage for transporting the documents one by one, said supply passage having a document standby point, a document transport unit for moving the document fed from said document supplying mechanism relative to said image scanning station, and a document discharging mechanism having a discharge passage through which the document from said document transport unit is discharged and means for discharging the document, which comprises:

determining a distance between said document standby point and said scanning reference point as leading length, determining a distance between said scanning reference point and said discharging means as transport length, sending the following document to said document standby point defined in said supply passage in said document supplying mechanism while treating said preceding document at said image scanning station, sending off said preceding document after treated in a forward direction, and simultaneously, forwarding said following document toward said image scanning station at a document interval obtained by a delay time determined in accordance with the length of said preceding document and said leading length, measuring the length of said following document moving along said supply passage in said document supplying mechanism, designating a switchback mode when a total of the measured length of said following document and said document interval are smaller than said transport length, designating a normal feed mode when the total of the measured length of said following document and said document interval are equal to or larger than said transport length, moving said following document backward to said scanning reference point in said switchback mode when said preceding document is discharged from said discharging mechanism, moving said following document forward to said scanning reference point in said normal feed mode when said preceding document is discharged from said discharging mechanism, and discharging said following document after treated at said image scanning station from said image scanning station through said discharging mechanism.

12. An automatic document feeding method for feeding and discharging documents including a preceding document to be sent earlier and a following document to be sent later one by one to and from an image scanning station having a scanning reference point by use of a document feeding device comprising a document supplying mechanism incorporating a supply tray for stacking one or more documents having respective lengths, and a supply passage for transporting the documents one by one, said supply passage having a document standby point, a document transport unit for moving the document fed from said document supplying mechanism relative to said image scanning station, and a document discharging mechanism having a discharge passage through which the document from said document transport unit is discharged and means for discharging the document, which comprises:

determining a distance between said document standby point and said scanning reference point as leading length, determining a distance between said scanning reference point and said discharging means as transport length, measuring the length of said preceding document being forwarded toward said image scanning station through said supply passage, determining a document interval from the measured length of said preceding document and said determined leading length, introducing said preceding document into said image scanning station to allow said preceding document to undergo an image processing operation at said image scanning station, sending the following document to said document standby point defined in said supply passage in said document supplying mechanism while treating said preceding document at said image scanning station, sending off said preceding document after treated in a forward direction, and simultaneously, forwarding said following document toward said image scanning station at a document interval obtained by a delay time determined in accordance with the length of said preceding document and said leading length, measuring the length of said following document moving along said supply passage in said document supplying mechanism, designating a switchback mode when a total of the measured length of said preceding document, the measured length of said following document and said document interval are smaller than said transport length, designating a normal feed mode when the total of the measured length of said preceding document, the measured length of said following document and said document interval are equal to or larger than said transport length, moving said following document backward to said scanning reference point in said switchback mode when said preceding document is discharged from said discharging mechanism, moving said following document forward to said scanning reference point in said normal feed mode when said preceding document is discharged from said discharging mechanism, and discharging said following document after treated at said image scanning station from said image scanning station through said discharging mechanism.

* * * * *